US011501697B2

(12) United States Patent
Liao et al.

(10) Patent No.: US 11,501,697 B2
(45) Date of Patent: Nov. 15, 2022

(54) PIXEL CIRCUIT AND DISPLAY DEVICE

(71) Applicant: Au Optronics Corporation, Hsinchu (TW)

(72) Inventors: Wei-Chien Liao, Hsinchu (TW); Meng-Chieh Tsai, Hsinchu (TW)

(73) Assignee: Au Optronics Corporation, Hsinchu (TW)

( * ) Notice: Subject to any disclaimer, the term of this patent is extended or adjusted under 35 U.S.C. 154(b) by 0 days.

(21) Appl. No.: 17/325,161

(22) Filed: May 19, 2021

(65) Prior Publication Data

US 2022/0114950 A1 Apr. 14, 2022

(30) Foreign Application Priority Data

Oct. 12, 2020 (TW) ..... 109135129

(51) Int. Cl.
*G09G 3/32* (2016.01)

(52) U.S. Cl.
CPC ..... *G09G 3/32* (2013.01); *G09G 2300/0439* (2013.01); *G09G 2300/0842* (2013.01); *G09G 2310/0267* (2013.01); *G09G 2310/0275* (2013.01)

(58) Field of Classification Search
CPC ..... G09G 3/32; G09G 2300/0439; G09G 2300/0842; G09G 2310/0267; G09G 2310/0275; G09G 3/3648; G09G 2230/00; G09G 2300/0861; G09G 3/20
See application file for complete search history.

(56) References Cited

U.S. PATENT DOCUMENTS

| | | | | |
|---|---|---|---|---|
| 7,053,875 | B2 * | 5/2006 | Chou | G09G 3/325 345/82 |
| 7,589,707 | B2 * | 9/2009 | Chou | G09G 3/3241 345/82 |
| 9,685,563 | B2 * | 6/2017 | Tsubuku | H01L 21/02488 |
| 9,929,279 | B2 * | 3/2018 | Yamazaki | H01L 29/42384 |
| 10,115,741 | B2 * | 10/2018 | Matsuda | H01L 27/127 |
| 10,600,767 | B2 * | 3/2020 | Chong | G09G 3/22 |
| 10,638,564 | B2 * | 4/2020 | Haimin | H05B 45/44 |
| 10,797,127 | B2 * | 10/2020 | Son | H01L 51/5203 |
| 10,916,589 | B2 * | 2/2021 | Bang | H01L 51/5265 |
| 11,211,020 | B2 * | 12/2021 | Ono | G09G 3/3291 |
| 2004/0189577 | A1 | 9/2004 | Lin et al. | |
| 2010/0073267 | A1 * | 3/2010 | Akimoto | G09G 3/3233 345/76 |
| 2019/0208593 | A1 * | 7/2019 | Haimin | F21K 9/27 |

* cited by examiner

*Primary Examiner* — Vijay Shankar
(74) *Attorney, Agent, or Firm* — JCIPRNET

(57) ABSTRACT

A pixel circuit and a display device are provided. The pixel circuit is utilized for driving a light emitting diode. The pixel circuit includes a storage capacitor, a selector, a memory device, and a write switch. The storage capacitor is coupled to the light emitting diode. The selector selects a first signal or a second signal to the storage capacitor according to a stored data. The memory device is coupled to the selector. The memory device stores a written data to obtain the stored data. The write switch is coupled to the memory device. The write switch writes in the written data to the memory device while the pixel circuit is in transition of operation modes.

16 Claims, 8 Drawing Sheets

PIXEL CIRCUIT AND DISPLAY DEVICE

CROSS-REFERENCE TO RELATED APPLICATION

This application claims the priority benefit of Taiwan application serial no. 109135129, filed on Oct. 12, 2020. The entirety of the above-mentioned patent application is hereby incorporated by reference herein and made a part of this specification.

BACKGROUND

Technical Field

The disclosure relates to a circuit and a device, and particularly relates to a pixel circuit and a display device.

Description of Related Art

The conventional pixel circuits or display devices may only selectively operate in the static mode or the dynamic mode, and the users are unable to switch the operations of the pixel circuits or the display devices according to requirements. Therefore, when the pixel circuits or the display devices are only allowed to operate in the static mode, the pixel circuits or the display devices are unable to display images of a high quality. Comparatively, when the pixel circuits or the display devices are only allowed to operate in the dynamic mode, the pixel circuits or the display devices are unable to carry out power-saving operations.

SUMMARY

The disclosure provides a pixel circuit and a display device switchable to operate in a static mode and/or a dynamic mode.

The pixel circuit of the disclosure is configured to drive a light emitting diode. The pixel circuit includes a storage capacitor, a selector, a memory device and a write switch. The storage capacitor is coupled to the light emitting diode. The selector selects a first signal or a second signal to the storage capacitor according to a stored data. The memory device is coupled to the selector. The memory device stores a written data to obtain the stored data. The write switch is coupled to the memory device. The write switch writes in the written data to the memory device while the pixel circuit is in transition of operation modes.

The display device of the disclosure includes multiple data lines and multiple pixel circuits. The pixel circuits are respectively coupled to the corresponding data lines. Each of the pixel circuits is configured to drive a light emitting diode, and the each of the pixel circuits includes a storage capacitor, a selector, a memory device and a write switch. The storage capacitor is coupled to the light emitting diode. The selector selects a first signal or a second signal to the storage capacitor according to a stored data. The memory device is coupled to the selector. The memory device stores a written data to obtain the stored data. The write switch is coupled to the memory device, and the write switch writes in the written data to the memory device while the pixel circuits are in transition of operation modes.

Based on the above, the pixel circuit and the display device may be switched to operate in the static mode and/or the dynamic mode. In this way, the operations of the pixel circuit and the display device may be adaptively switched according to different usage requirements.

To make the aforementioned more comprehensible, several embodiments accompanied with drawings are described in detail as follows.

BRIEF DESCRIPTION OF THE DRAWINGS

The accompanying drawings are included to provide a further understanding of the disclosure, and are incorporated in and constitute a part of this specification. The drawings illustrate exemplary embodiments of the disclosure and, together with the description, serve to explain the principles of the disclosure.

DESCRIPTION OF THE EMBODIMENTS

Figure 1:
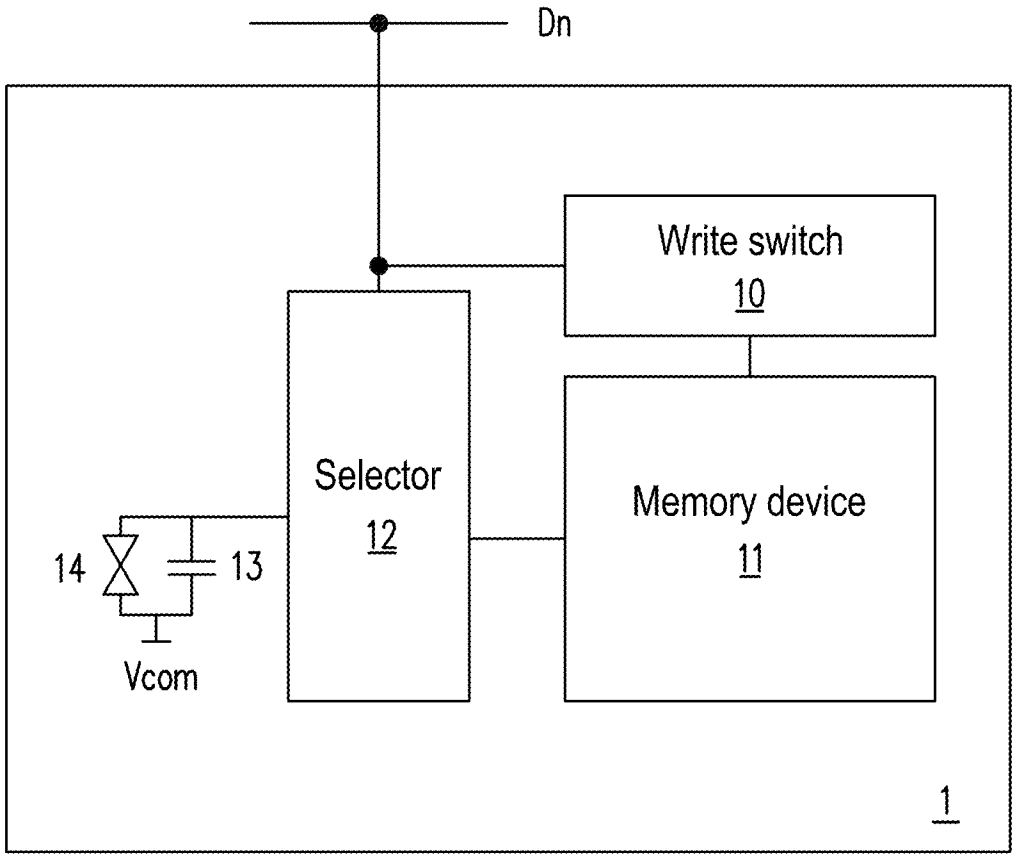
FIG. 1 is a schematic diagram of a pixel circuit according to an embodiment of the disclosure.

FIG. 1 is a schematic diagram of a pixel circuit 1 according to an embodiment of the disclosure. The pixel circuit 1 includes a write switch 10, a memory device 11, a selector 12, a storage capacitor 13 and a light emitting diode 14. The write switch 10 may write in a written data to the memory device 11 while the pixel circuit 1 is in transition of operation modes. The memory device 11 is coupled to the write switch 10, and the memory device 11 may store the written data to obtain a stored data. The selector 12 is coupled to the memory device 11, and the selector 12 may select to provide a first signal or a second signal to the storage capacitor 13 according to the stored data. In short, the pixel circuit 1 may have multiple operation modes. The memory device 11 of the pixel circuit 1 may obtain the written data through the write switch 10 and store the written data as the stored data in the memory device 11 while the pixel circuit 1 is in transition of operation modes. Furthermore, the memory device 11 may control the selector 12 according to the stored data. Accordingly, the selector 12 may select to provide the first data or the second data to the storage capacitor 13 and the light emitting diode 14 for display.

In an embodiment, the multiple operation modes of the pixel circuit 1 may include a dynamic mode and a static mode. When the pixel circuit 1 is switched between the dynamic mode and the static mode, the write switch 10 may be turned on to obtain the written data from a data line Dn, and the write switch 10 writes in the written data to the memory device 11 to become the stored data. In addition, when the pixel circuit 1 operates in the dynamic mode or the static mode, the write switch 10 may be turned off. The memory device 11 may control the selector 12 according to the stored data.

In detail, in a first writing time period during transition of the pixel circuit 1 from the dynamic mode to the static mode, the written data is a static display data, and the static display data is written into the memory device 11 through the write switch 10 to become the stored data. In this way, when the pixel circuit 1 operates in the static mode, the memory device 11 may control the selector 12 according to the stored static display data. Accordingly, the selector 12 selects the first signal or the second signal to the storage capacitor 13.

When the pixel circuit 1 operates in the static mode, the first signal and the second signal are pulse width modulation signals inverted with respect to each other.

In a second writing time period during transition of the pixel circuit 1 from the static mode to the dynamic mode, the written data having a first logic level is written into the memory device 11 through the write switch 10 to become the stored data. In this way, when the pixel circuit 1 then operates in the dynamic mode, the first signal may be a dynamic display data, and the selector 12 may provide the first signal of the dynamic display data to the storage capacitor 13 according to the stored data of the memory device 11 for display.

In short, before the pixel circuit 1 executes each of the operation modes, data may be written into the memory device 11 of the pixel circuit 1 through the writing time period. Accordingly, the memory device 11 may control the pixel circuit 1 to perform the display operation corresponding to the operation mode according to the stored data when executing the operation mode. Therefore, the pixel circuit 1 may have display modes with multiple functions, and the pixel circuit 1 may be switched to the static mode or the dynamic mode according to usage requirements to perform power-saving display operations or provide high-quality display images.

Figure 2:
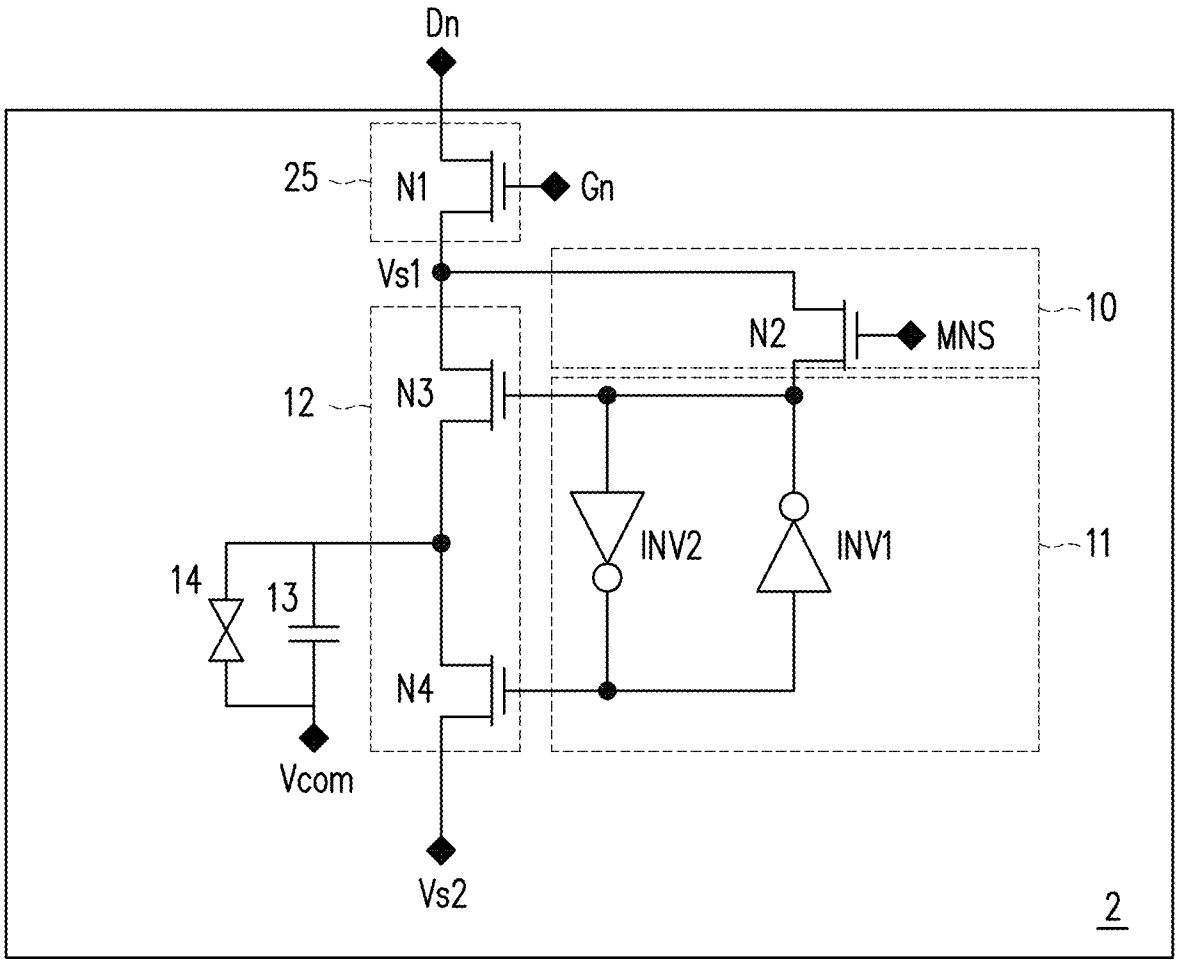
FIG. 2 is a schematic diagram of a pixel circuit according to an embodiment of the disclosure.

FIG. 2 is a schematic diagram of a pixel circuit 2 according to an embodiment of the disclosure. The pixel circuit 2 is similar to the pixel circuit 1 in FIG. 1. The pixel circuit 2 includes the write switch 10, the memory device 11, the selector 12, the storage capacitor 13, the light emitting diode 14 and a data write switch 25. The data write switch 25 is coupled to the write switch 10, the memory device 11 and the data line Dn. The data write switch 25 may determine whether to transmit a signal on the data line Dn to the selector 12 and the write switch 10 according to a gate scan signal.

In this embodiment, the data write switch 25 is coupled to the data line Dn, the write switch 10 and the selector 12, and a control end of the data write switch 25 is coupled to a gate line Gn. The data write switch 25 may include a transistor N1. The first end (for example, the drain) of the transistor N1 is coupled to the data line Dn. The second end (for example, the source) of the transistor N1 is coupled to the write switch 10 and the selector 12. The control end (for example, the gate) of the transistor N1 is coupled to the gate line Gn to receive a gate scan signal VGn.

The write switch 10 is coupled between the data write switch 25 and the memory device 11, and the write switch 10 receives a write control signal MNS at the control end. The write switch 10 may include a transistor N2. The first end (for example, the drain) of the transistor N2 is coupled to the second end of the transistor N1. The second end (for example, the source) of the transistor N2 is coupled to the memory device 11. The control end (for example, the gate) of the transistor N2 receives the write control signal MNS.

The memory device 11 may be, for example, a latch circuit. The memory device 11 is coupled to the write switch 10 to receive the written data. The memory device 11 may include inverters INV1 and INV2. An output end of the inverter INV1 is coupled to an input end of the inverter INV2, and the output end of the inverter INV2 is coupled to the input end of the inverter INV1. In addition, the output end of the inverter INV1 is coupled to the second end (for example, the source) of the transistor N2. Therefore, the memory device 11 may store the written data provided by the write switch 10 as the stored data stored through the inverters INV1 and INV2.

The selector 12 is coupled to the data write switch 25 and the memory device 11. A first control end of the selector 12 receives the stored data provided by the memory device 11, and a second control end of the selector 12 receives an inverted stored data provided by the memory device 11. The selector 12 receives a first signal Vs1 and a second signal Vs2. The selector 12 may select to provide the first signal Vs1 or the second signal Vs2 to the storage capacitor 13 according to the stored data and/or the inverted stored data. The selector 12 includes a first transistor N3 and a second transistor N4. The first end (for example, the drain) of the first transistor N3 is coupled to the second end of the transistor N1 to receive the first signal Vs1. The second end (for example, the source) of the first transistor N3 is coupled to the storage capacitor 13. The control end (for example, the gate) of the first transistor N3 is the first control end of the selector 12 and is coupled to the output end of the inverter INV1 to receive the stored data provided by the memory device 11. The first end (for example, the drain) of the second transistor N4 receives the second signal Vs2. The second end (for example, the source) of the second transistor N4 is coupled to the second end of the first transistor N3, and the second end (for example, the source) of the second transistor N4 is coupled to the storage capacitor 13. The control end (for example, the gate) of the second transistor N4 is the second control end of the selector 12, and is coupled to the output end of the inverter INV2 to receive the inverted stored data provided by the memory device 11.

The storage capacitor 13 and the light emitting diode 14 are connected in parallel. One end of the storage capacitor 13 and the light emitting diode 14 are coupled to the selector 12, and the other end of the storage capacitor 13 and the light emitting diode 14 receive a common voltage signal Vcom.

Figure 3A:
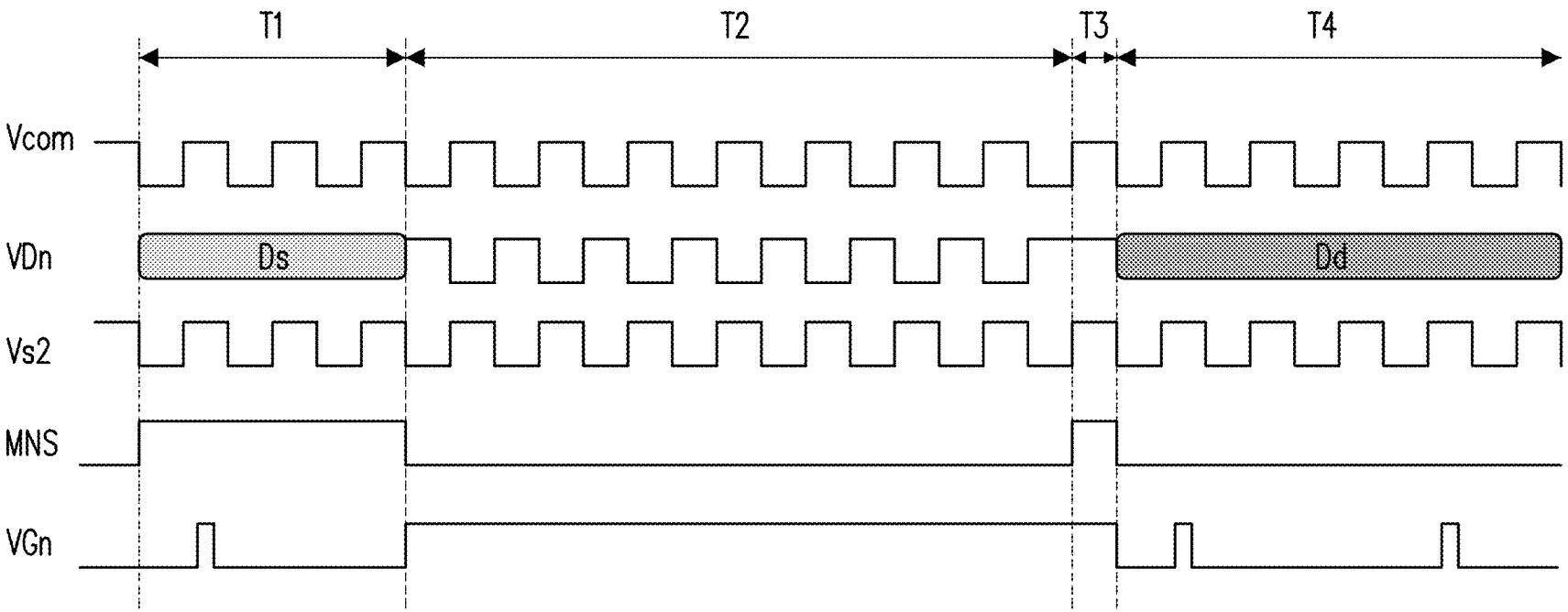
FIG. 3A is a waveform diagram of operation of the pixel circuit shown in FIG. 2.

FIG. 3A is a waveform diagram of operation of the pixel circuit 2 shown in FIG. 2. FIG. 3B to FIG. 3E are schematic diagrams of operation of the pixel circuit 2 shown in FIG. 2 in different time periods. In detail, FIG. 3A shows the operation waveforms of the common voltage signal Vcom, a voltage VDn on the data line Dn, the second signal Vs2, the write control signal MNS, and the gate scan signal VGn on the gate line Gn in multiple time periods T1 to T4. In the following, descriptions will be made with reference to FIG. 3A to FIG. 3E to better understand the operation of the pixel circuit 2 in the time periods T1 to T4.

Figure 3B:
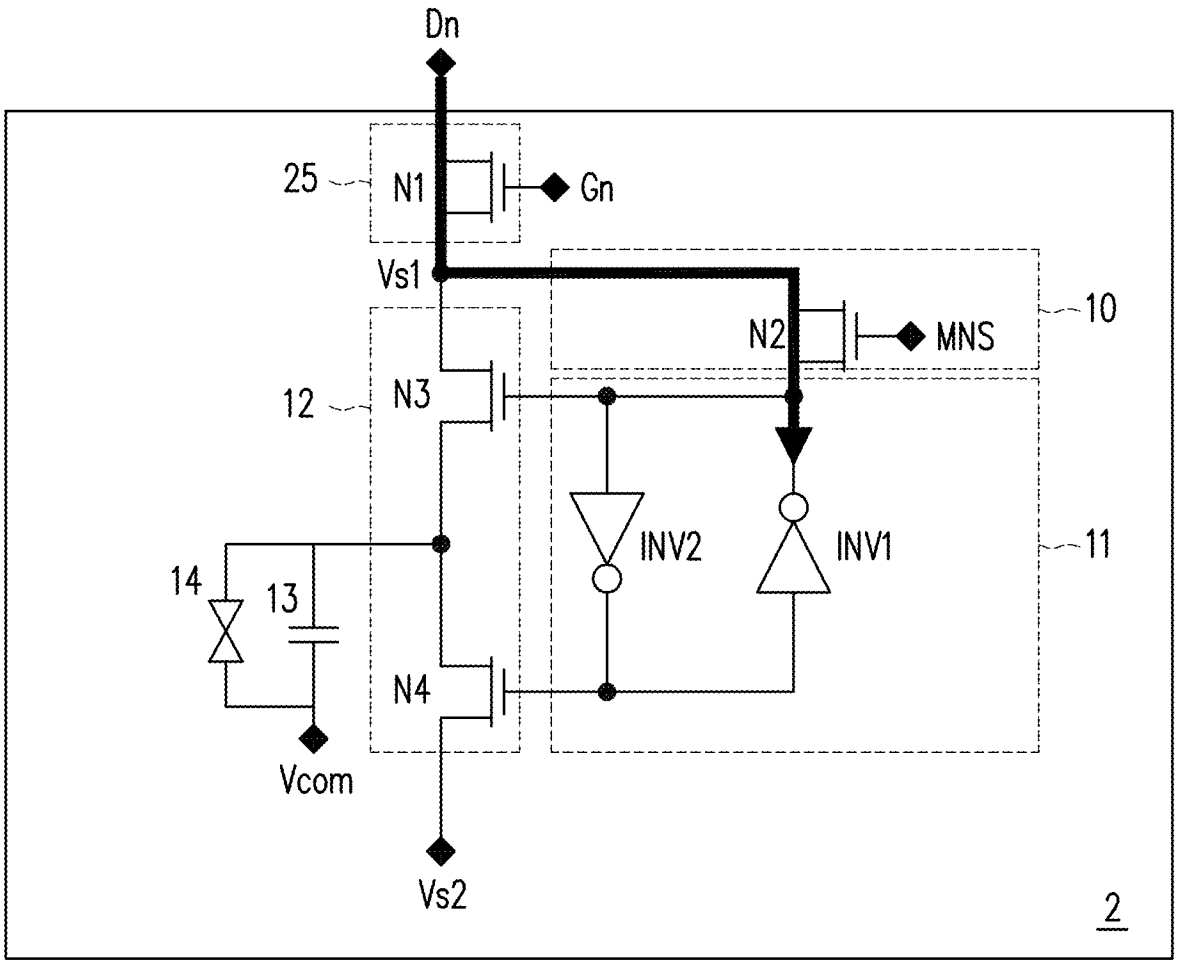
FIG. 3B to FIG. 3E are schematic diagrams of operation of a pixel circuit 2 shown in FIG. 2 in different time periods.

In the time period T1, the pixel circuit 2 operates in the first writing time period. As shown in FIG. 3A, the gate scan signal VGn may be a pulse square wave, the write control signal MNS may be at the first logic level (for example, a high voltage level), and the data line Dn may provide a static display data Ds in the time period T1. For example, the length of the time period T1 may be a frame time. Through the time when the gate scan signal VGn has the first logic level (for example, the high voltage level), the pixel circuit 2 may be controlled to obtain corresponding static display data. In this way, as shown in FIG. 3B, the transistors N1 and N2 may be respectively turned on by the gate scan signal VGn and the write control signal MNS. The static display data Ds provided on the data line Dn may be written into the memory device 11 and stored as the stored data.

Figure 3C:
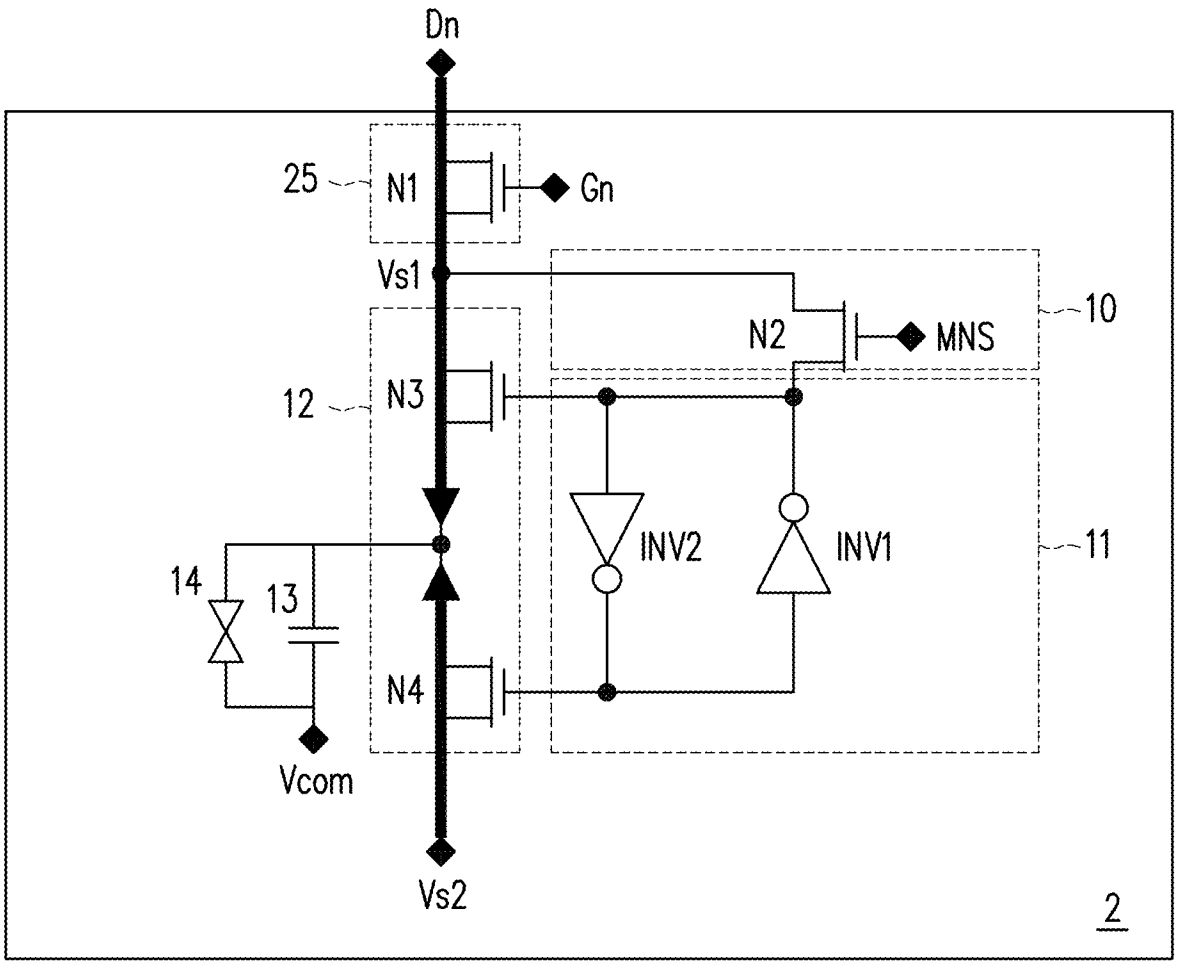

In the time period T2, the pixel circuit 2 operates in the static mode. As shown in FIG. 3A, the gate scan signal VGn may be at the first logic level (for example, the high voltage level), and the write control signal MNS may be a second logic level (for example, a low voltage level). In the time period T2, the selector 12 may receive the pulse width modulation signal as the first signal Vs1 through the data line Dn, and the selector 12 may receive an inverted pulse width modulation signal inverted with respect to the pulse width modulation signal as the second signal Vs2. The pulse width modulation signal may be inverted with respect to the common voltage signal Vcom. In this way, as shown in FIG. 3C, the transistor N1 may be turned on, and the transistor N2 may be turned off. The selector 12 may receive the pulse width modulation signal as the first signal Vs1 through the data line Dn, and receive the inverted pulse width modulation signal as the second signal Vs2. The memory device 11 controls the selector 12 according to the stored static display data Ds. Accordingly, the selector 12 provides the first signal Vs1 or the second signal Vs2 to the storage capacitor 13.

Therefore, in the first writing time period, the pixel circuit 2 may obtain the static display data Ds and store the static display data Ds in the memory device 11. In this way, in a static mode time period after the first writing time period, the pixel circuit 2 may operate in the static mode and select the pulse width modulation signal (i.e. the first signal Vs1) or the inverted pulse width modulation signal (i.e., the second signal Vs2) according to the static display data Ds stored in the memory device 11 for display.

Figure 3D:
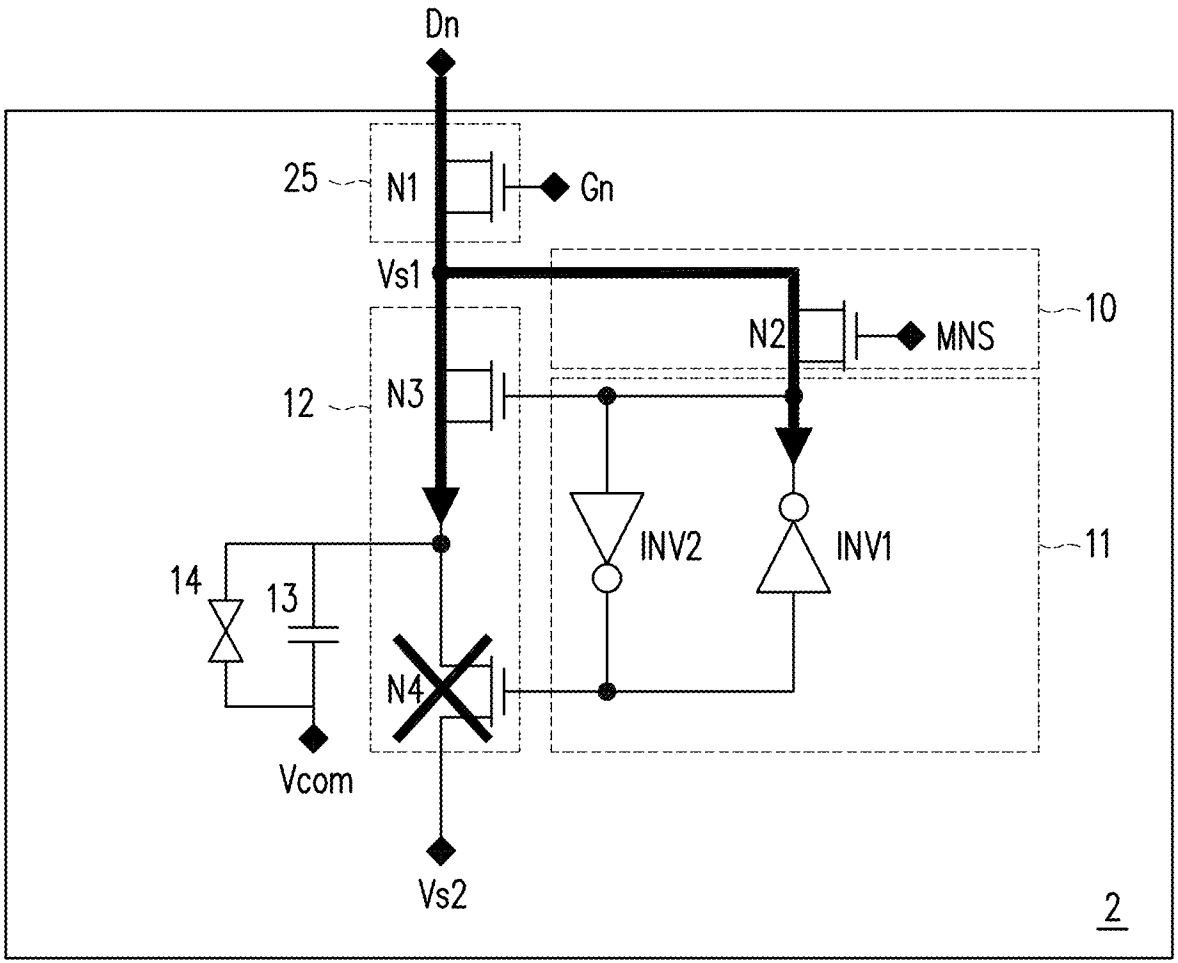

In the time period T3, the pixel circuit 2 operates in the second writing time period. As shown in FIG. 3A, the gate scan signal VGn and the write control signal MNS may be at the first logic level (for example, the high voltage level), and the data line Dn is also at the first logic level (for example, the high voltage level) in the time period T1. In this way, as shown in FIG. 3D, the transistors N1 and N2 may be respectively turned on by the gate scan signal VGn and the write control signal MNS, and the written data of the first logic level (for example, the high voltage level) may be written into the memory device 11 to become the stored data.

Figure 3E:
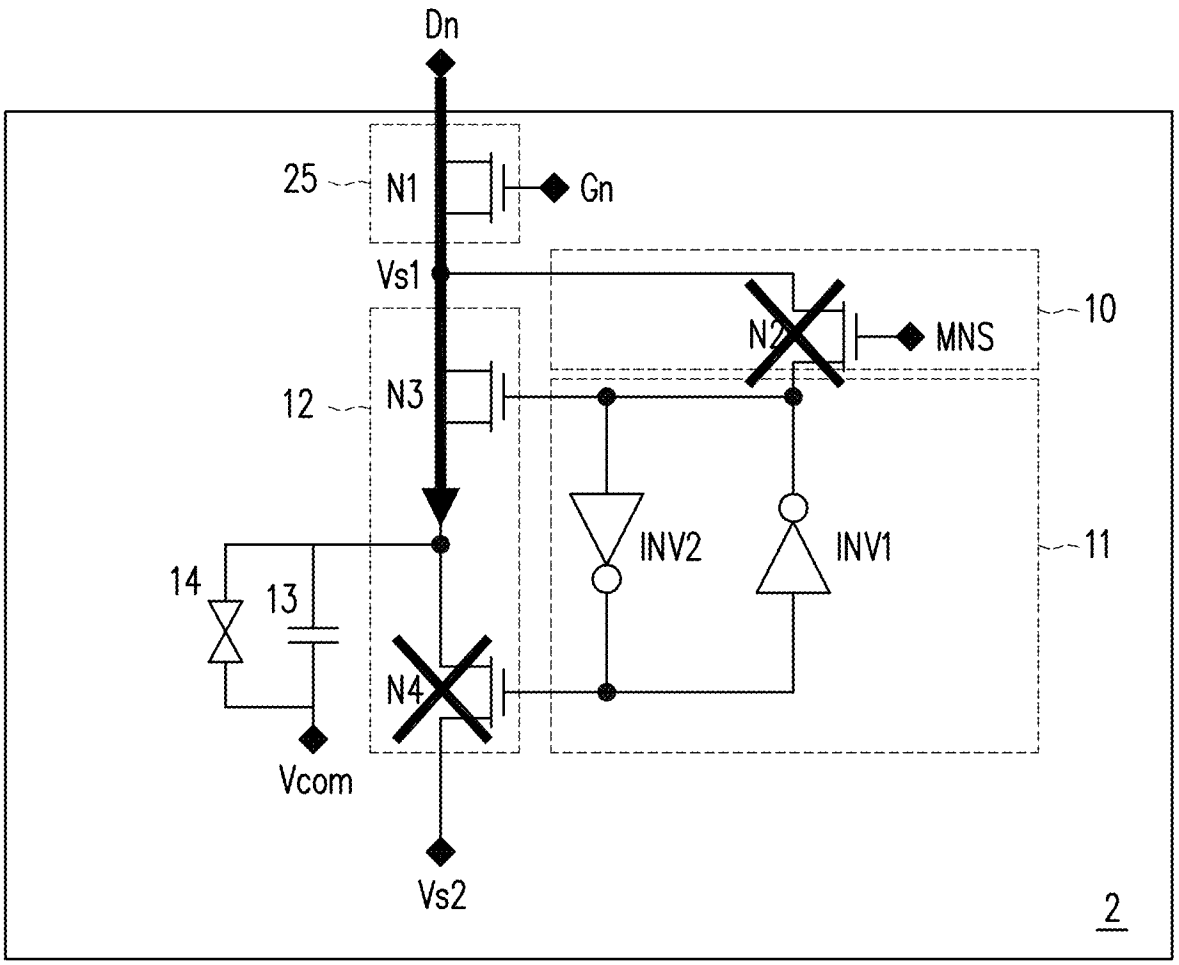

In the time period T4, the pixel circuit 2 operates in the dynamic mode. As shown in FIG. 3A, the gate scan signal VGn may be a periodic pulse square wave, the write control signal MNS may be at the second logic level (for example, the low voltage level), and the data line Dn may provide the dynamic display data in the time period T4. In this way, as shown in FIG. 3E, the transistor N2 may be turned off. The transistor N1 may be controlled by the gate scan signal VGn to be turned on to provide a dynamic display data Dd to the selector 12 through the data line Dn at a corresponding time. The selector 12 is controlled by the memory device 11. The stored data of the first logic level (for example, the high voltage level) stored in the memory device 11 may control the first transistor N3 of the selector 12 to be turned on and the second transistor N4 to be turned off. Accordingly, the selector 12 provides the dynamic display data Dd to the storage capacitor 13 according to the stored data for display.

Therefore, in the second writing time period, the memory device 11 of the pixel circuit 2 may store the stored data having the first logic level. In this way, in a dynamic mode time period after the second writing time period, the pixel circuit 2 may operate in the dynamic mode, and the memory device 11 may control the selector 12 to receive the dynamic display data Dd from the data line Dn for display.

In short, the pixel circuit 2 may have the static mode and the dynamic mode. By arranging the first writing time period and the second writing time period to switch between the static mode and the dynamic mode, the pixel circuit 2 may write in the written data to the memory device 11. Accordingly, the pixel circuit 2 may display statically in the static mode according to the static display data Ds written in the first writing time period. Alternatively, the pixel circuit 2 may continuously obtain the dynamic display data Dd from the data line Dn for display in the dynamic mode according to the stored data written in the second writing time period.

According to different design requirements, a person of ordinary skill in the art may of course adjust or change the operation of the pixel circuit 1 or the pixel circuit 2. In an embodiment, the static display data Ds may be an one-bit display data, and the dynamic display data Dd may be an eight-bit display data or display data of other suitable number of bits. Therefore, in the dynamic mode, the pixel circuit 2 may perform a dynamic display operation with better image resolution than the image resolution in the static mode.

For example, the first writing time period is not limited to being arranged during the transition of the pixel circuit 2 from the dynamic mode to the static mode. When the pixel circuit 2 operates in the static mode, the first writing time period may also be inserted between static modes at a predetermined time interval (for example, 3 seconds, 6 seconds, or other suitable time intervals). In this way, the pixel circuit 2 may update the static display data Ds stored in the memory device 11 at the predetermined time interval.

Figure 4:
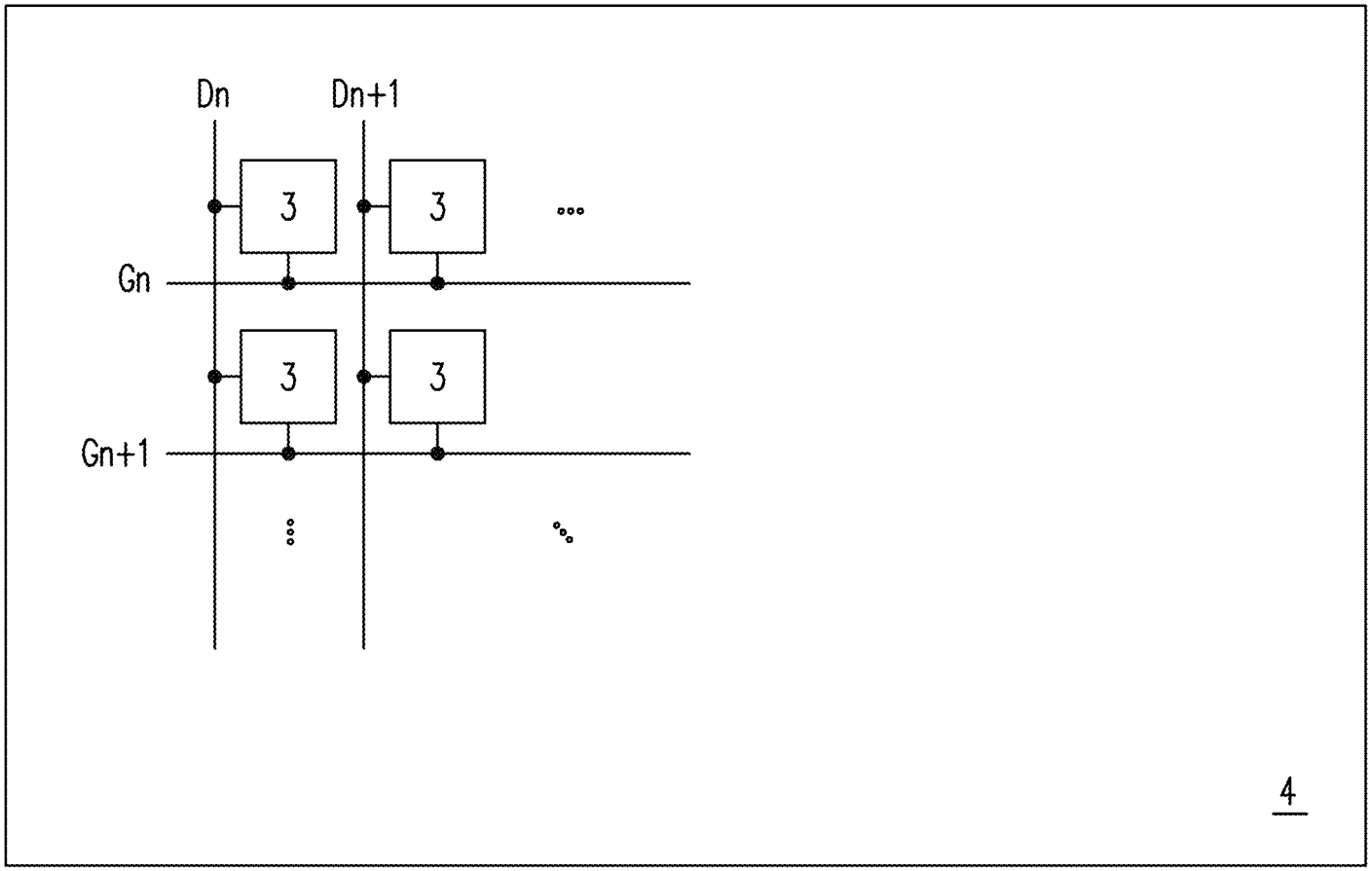
FIG. 4 is a schematic diagram of a display device according to an embodiment of the disclosure.

FIG. 4 is a schematic diagram of a display device 4 according to an embodiment of the disclosure. The display device 4 includes multiple pixel circuits 3. The pixel circuit 3 may be realized by the pixel circuit 1 shown in FIG. 1 or the pixel circuit 2 shown in FIG. 2. The operations of the pixel circuits 1 and 2 have been described in the foregoing and therefore will not be repeated in the following. In general, the display device 4 may control the pixel circuit 3 to set the first writing time period and/or the second writing time period. Accordingly, the display device 4 operates in the static mode and/or the dynamic mode. Therefore, the display device 4 provided with the pixel circuit 3 may also be capable of operations with multiple functions which effectively enhance the user experience.

In an embodiment, the pixel circuit in the display device 4 may have multiple sub-pixel circuits, and each sub-pixel circuit may be implemented by the pixel circuit 3. For example, a red pixel in the display device 4 may have three sub-pixel circuits. In this way, when the display device 4 operates in the static mode, the display device 4 may make adjustment to turn on/off each sub-pixel circuit to adjust the grayscale brightness of the red pixel. In this example, the number of the sub-pixel circuits that are turned on in the red pixel may be 0, 1, 2, or 3, that is, the red pixel in the display device 4 may have four grayscale brightness levels. Furthermore, when the red, green, and blue pixels in the display device 4 each have three sub-pixel circuits, the display device 4 may have 64 grayscale brightness levels. Therefore, through the overall configuration, the display device 4 may provide richer image colors in the static mode.

In summary, the pixel circuit and the display device of the disclosure may operate in multiple operation modes, and the memory device may be written in through the writing time periods in transition of the each of the operation modes. In this way, the memory device may control the selector according to the stored data. Accordingly, the selector selects to provide the corresponding signal to the storage capacitor for display. Therefore, the pixel circuit and the display device may have multiple operation modes, and may adaptively switch the operation modes according to different usage requirements, thereby enhancing the user experience.

It will be apparent to those skilled in the art that various modifications and variations can be made to the disclosed embodiments without departing from the scope or spirit of the disclosure. In view of the foregoing, it is intended that the disclosure covers modifications and variations provided that they fall within the scope of the following claims and their equivalents.

What is claimed is:

1. A display device, comprising:

a plurality of data lines;

a plurality of pixel circuits, respectively coupled to the corresponding data lines, wherein each of the pixel circuits is configured to drive a light emitting diode, and the each of the pixel circuits comprises:

a storage capacitor, coupled to the light emitting diode;

a selector, selecting a first signal or a second signal to the storage capacitor according to a stored data;

a memory device, coupled to the selector, wherein the memory device stores a written data to obtain the stored data; and a write switch, coupled to the memory device, wherein the write switch writes in the written data to the memory device while the each of the pixel circuits is in transition of operation modes, wherein the selector comprises:

a first transistor, wherein a first end of the first transistor receives the first signal, a second end of the first transistor is coupled to the storage capacitor, and a control end of the first transistor receives the stored data; and a second transistor, a first end of the second transistor receives the second signal, a second end of the second transistor is coupled to the storage capacitor, and a control end of the second transistor receives an inverted stored data.

2. The display device according to claim 1, wherein when the each of the pixel circuits operates in a dynamic mode or a static mode, the write switch is turned off, wherein when the each of the pixel circuits is in transition of the dynamic mode and the static mode, the write switch is turned on to write in the written data to the memory device.

3. The display device according to claim 1, wherein in a first writing time period before the each of the pixel circuits is switched to a static mode, the written data is a static display data, and the static display data is written in to become the stored data.

4. The display device according to claim 3, wherein when the each of the pixel circuits operates in the static mode, the first signal and the second signal are pulse width modulation signals inverted with respect to each other, and the memory device controls the selector according to the stored static display data to provide the first signal or the second signal to the storage capacitor.

5. The display device according to claim 1, wherein in a second writing time period before the each of the pixel circuits is switched to a dynamic mode, the written data having a first logic level is written in to become the stored data.

6. The display device according to claim 5, wherein when the each of the pixel circuits operates in the dynamic mode, the first signal is a dynamic display data, and the selector provides the dynamic display data to the storage capacitor for display according to the stored data.

7. The display device according to claim 1, wherein the memory device is a latch circuit.

8. The display device according to claim 1, further comprising a data transmission switch coupled to the selector and the write switch, wherein the data transmission switch determines whether to transmit a signal to the selector and the write switch according to a gate scan signal.

9. A pixel circuit for driving a light emitting diode, the pixel circuit comprising:

a storage capacitor, coupled to the light emitting diode;

a selector, selecting a first signal or a second signal to the storage capacitor according to a stored data;

a memory device, coupled to the selector, wherein the memory device stores a written data to obtain the stored data; and a write switch, coupled to the memory device, wherein the write switch writes in the written data to the memory device while the pixel circuit is in transition of operation modes, wherein the selector comprises:

a first transistor, wherein a first end of the first transistor receives the first signal, a second end of the first transistor is coupled to the storage capacitor, and a control end of the first transistor receives the stored data; and a second transistor, wherein a first end of the second transistor receives the second signal, a second end of the second transistor is coupled to the storage capacitor, and a control end of the second transistor receives an inverted stored data.

10. The pixel circuit according to claim 9, wherein when the pixel circuit operates in a dynamic mode or a static mode, the write switch is turned off, wherein when the pixel circuit is in transition of the dynamic mode and the static mode, the write switch is turned on to write in the written data to the memory device.

11. The pixel circuit according to claim 9, wherein in a first writing time period before the pixel circuit is switched to a static mode, the written data is a static display data, and the static display data is written in to become the stored data.

12. The pixel circuit according to claim 11, wherein when the pixel circuit operates in the static mode, the first signal and the second signal are pulse width modulation signals inverted with respect to each other, and the memory device controls the selector according to the stored static display data to provide the first signal or the second signal to the storage capacitor.

13. The pixel circuit according to claim 9, wherein in a second writing time period before the pixel circuit is switched to a dynamic mode, the written data having a first logic level is written in to become the stored data.

14. The pixel circuit according to claim 13, wherein when the pixel circuit operates in the dynamic mode, the first signal is a dynamic display data, and the selector provides the dynamic display data to the storage capacitor for display according to the stored data.

15. The pixel circuit according to claim 9, wherein the memory device is a latch circuit.

16. The pixel circuit according to claim 9, further comprising a data transmission switch coupled to the selector and the write switch, wherein the data transmission switch determines whether to transmit a signal to the selector and the write switch according to a gate scan signal.

* * * * *